United States Patent [19]

Gorski

[11] 3,960,746

[45] June 1, 1976

[54] AZEOTROPE-LIKE COMPOSITIONS OF METHANOL, NITROMETHANE AND TRICHLOROTRIFLUOROETHANE

[75] Inventor: Robert Alexander Gorski, Newark, Del.

[73] Assignee: E. I. Du Pont de Nemours and Company, Wilmington, Del.

[22] Filed: July 25, 1974

[21] Appl. No.: 491,684

[52] U.S. Cl. ..... 252/171; 252/DIG. 9; 260/652.5 R

[51] Int. Cl.[2] ..... C11D 7/50

[58] Field of Search ..... 252/171, 170, DIG. 9; 260/652.5

[56] References Cited

UNITED STATES PATENTS

| | | | |
|---|---|---|---|
| 2,999,816 | 9/1961 | Bennett et al. | 252/171 |
| 3,085,116 | 4/1963 | Kvalnes | 260/652.5 |
| 3,723,332 | 3/1973 | Barton | 252/171 |
| 3,789,006 | 1/1974 | McMillan | 252/171 |

*Primary Examiner*—William E. Schulz
*Attorney, Agent, or Firm*—James A. Costello

[57] ABSTRACT

Azeotrope-like compositions comprising from 5.0 to 6.3 weight percent of methanol, from 0.05 to 0.6 weight percent of nitromethane and from 93.1 to 94.95 weight percent of 1,1,2-trichloro-1,2,2-trifluoroethane, the compositions being useful for cleaning printed circuit boards.

2 Claims, No Drawings

AZEOTROPE-LIKE COMPOSITIONS OF METHANOL, NITROMETHANE AND TRICHLOROTRIFLUOROETHANE

BACKGROUND OF THE INVENTION

The azeotrope-like compositions of this invention are excellent defluxing solvents for circuit boards used in the electronics industry. Such circuit boards normally consist of a glass fiber reinforced plate of electrically resistant plastic having electrical connectors on one side thereof. The connectors are thin flat strips of conductive metal, usually copper, which serve to interconnect the electronic components attached to the opposite side of the circuit board. The electrical integrity of the contacts between the connectors and the components is assured by soldering.

Current industrial processes of soldering circuit boards involve coating the entire circuit side of the board with a flux and thereafter passing the coated side of the board through molten solder. The flux cleans the conductive metal parts and promotes adhesion of the solder. The preferred fluxes consist for the most part of rosin used alone or with activating additives such as an amine hydrochloride, trimethylamine hydrochloride, or oxalic acid derivative.

After soldering, which thermally degrades part of the rosin, the flux is removed from the board by means of an organic solvent. Many of the solvents suggested for this application attack the organic materials from which circuit boards are often made, and other solvents are undesirable because of their degree of flammability and toxicity.

One suggested solvent for cleaning circuit boards is 1,1,2-trichloro-1,2,2-trifluoroethane, which is nonflammable, low in toxicity, and nonaggressive. To increase the flux-dissolving ability of trichlorotrifluoroethane, it has been suggested to mix more-active solvents therewith. More-active solvents include lower alcohols such as methanol which, however, in combination with trichlorotrifluoroethane may (undesirably) attack reactive metals such as zinc and aluminum, as well as certain aluminum alloys and chromate coatings that may be employed in circuit board assemblies. In this respect, methanol is the most aggressive of the common alcohols, and is not used in contact with these metals.

The solvent compositions of this invention possess the advantages of trichlorotrifluoroethane/methanol combinations but without the disadvantage of aggressiveness toward the reactive metals noted above. The subject compositions are not suitable for use with more-reactive metals such as the alkaline earths and the alkalis. These metals normally are not found on printed circuit boards.

Use of nitromethane to prevent metal attack by trichlorotrifluoroethane mixtures with other alcohols is known. Use of these mixtures to deflux circuit boards is known. These mixtures cannot be used at the boil where cleaning power and economy are much better, because the solvent can change in composition as it is used. The compositions of this invention however are useful at the boil and give good metal protection throughout the life of the solvent.

SUMMARY OF THE INVENTION

This invention concerns azeotrope-like compositions comprising from 5.0 to 6.3 weight percent of methanol, from 0.05 to 0.6 weight percent of nitromethane and from 93.1 to 94.95 weight percent of 1,1,2-trichloro-1,2,2-trifluoroethane. The most preferred compositions of this invention contain 5.5 to 5.9% methanol and 0.1 to 0.3% nitromethane, balance trichlorotrifluoroethane, all based on weight.

The compositions of this invention are characterized as "azeotrope-like" because, under use conditions as described in the Examples, they behave like azeotropes. That is, the composition of the vapor formed during boiling or evaporation is almost identical to the original liquid composition. During boilding or evaporation then, as when used in a vapor degreaser as described hereafter, the liquid composition changes only minimally. By contrast, non-azeotropic compositions, through the distillation process and evaporation loss, exhibit increasingly divergent solvent compositions, accompanied by the loss of at least one component and its beneficial effects.

The novel compositions of this invention are further characterized as being nonflammable in air under all conditions, whereas compositions containing greater amounts of methanol or nitromethane becomes flammable on evaporation. In addition, the present solvents inhibit the attack on active metals that would normally take place under anaerobic conditions, such as those encountered in a vapor degreaser. This result is in contrast to combinations of methanol and halogenated hydrocarbons without nitromethane. Suprisingly, this advantage is realized with no depreciation in the defluxing capability of the azeotrope-like compositions.

The novel compositions are prepared by admixing the individual constituents in the specified proportions. Each constituent is commercially available in a high degree of purity. While it is preferable to have the constituents in a high degree of purity, minor impurities will normally not adversely affect the performance of the azeotrope-like compositions.

DETAILS OF THE INVENTION

Vapor degreasers are usually employed to apply the solvent compositions of this invention to the circuit boards to be cleaned of rosin-based flux. In the conventional operation of a vapor degreaser, the board is passed through a sump of boiling solvent, which removes the bulk of the rosin, and thereafter through a sump containing freshly distilled solvent near room temperature, and finally through solvent vapors over the boiling sump which provides a final rinse with clean pure solvent that condenses on the circuit board. In addition, the board can also be sprayed with distilled solvent before final rinsing.

These azeotrope-like compositions are found to be very sensitive to changes in methanol concentration. Any deviation in the alcohol concentration outside the range of 5.0 to 6.3% results in compositions which undergo marked change in composition during boiling or evaporation. On the other hand, the compositions are relatively insensitive to changes in nitromethane concentration. Up to 0.6 weight % nitromethane can be present without loss of the azeotrope-like character of the composition.

There is evidence that a true azeotrope exists containing approximately 6.1% by weight methanol, 0.01% by weight nitromethane and the remainder (about 93.89%) 1,1,2-trichloro-1,2,2-trifluoroethane. While this true azeotrope is a satisfactory defluxing solvent, like the binary azeotrope of methanol and 1,1,2-trichloro-1,2,2-trifluoroethane, it attacks certain active metals. In order to prevent this attack, it has been found that the compositions must contain at least 0.05% by weight nitromethane.

The following Examples are meant to illustrate this invention.

sump turnover was 2.0 to 2.2 times/hour. Based on a vapor/air interface of 445.94 sq. cm., the average rate of solvent loss was about 0.015 to 0.12 g/hr/cm.$^2$. The results are shown in Table 1 with Comparisons A to I being outside the invention.

TABLE 1

| Example Number/ Comparison Letter | Component | Analyzed Composition of Samples Collected During Eight Hours of Operation, wt. % | | | | | | | |
|---|---|---|---|---|---|---|---|---|---|
| | | Boil Sump Sample (1) | | | | Rinse Sump Sample (1) | | | |
| | | A | B | C | D | A | B | C | D |
| 1 | $C_2F_3Cl_3$ | 94.52 | 94.55 | 94.70 | 94.74 | 94.76 | 94.41 | 94.47 | 94.23 |
| | Methanol | 5.28 | 5.25 | 5.10 | 5.06 | 5.05 | 5.40 | 5.34 | 5.58 |
| | Nitromethane | 0.20 | 0.20 | 0.20 | 0.20 | 0.19 | 0.19 | 0.19 | 0.19 |
| 2 | $C_2F_3Cl_3$ | 93.70 | 93.66 | 93.56 | 93.52 | 93.72 | 93.78 | 93.84 | 93.84 |
| | Methanol | 6.10 | 6.14 | 6.23 | 6.27 | 6.08 | 6.03 | 5.97 | 5.97 |
| | Nitromethane | 0.20 | 0.20 | 0.21 | 0.21 | 0.20 | 0.19 | 0.19 | 0.19 |
| A | $C_2F_3Cl_3$ | 95.40 | 95.90 | 96.14 | 96.67 | 95.49 | 94.04 | 94.04 | 94.19 |
| | Methanol | 4.13 | 3.64 | 3.41 | 2.83 | 4.11 | 5.52 | 5.51 | 5.35 |
| | Nitromethane | 0.47 | 0.46 | 0.45 | 0.45 | 0.40 | 0.44 | 0.45 | 0.45 |
| B | $C_2F_3Cl_3$ | 95.43 | 95.90 | 96.14 | 96.28 | 95.43 | 94.01 | 93.95 | 93.95 |
| | Methanol | 4.07 | 3.60 | 3.35 | 3.21 | 4.07 | 5.52 | 5.57 | 5.56 |
| | Nitromethane | 0.50 | 0.50 | 0.51 | 0.51 | 0.50 | 0.47 | 0.48 | 0.49 |
| C | $C_2F_3Cl_3$ | 91.36 | 89.49 | 88.88 | 88.59 | 91.55 | 93.08 | 93.45 | 93.49 |
| | Methanol | 8.26 | 10.06 | 10.64 | 10.92 | 8.08 | 6.59 | 6.23 | 6.20 |
| | Nitromethane | 0.38 | 0.45 | 0.48 | 0.49 | 0.37 | 0.33 | 0.32 | 0.31 |
| D | $C_2F_3Cl_3$ | 94.76 | 94.92 | 95.31 | 95.56 | 94.75 | 94.05 | 94.20 | 94.03 |
| | Methanol | 5.05 | 4.88 | 4.49 | 4.24 | 5.05 | 5.77 | 5.61 | 5.78 |
| | Nitromethane | 0.19 | 0.20 | 0.20 | 0.20 | 0.20 | 0.18 | 0.19 | 0.19 |
| E | $C_2F_3Cl_3$ | 92.76 | 91.86 | 91.73 | — | 92.77 | 93.53 | 93.57 | — |
| | Methanol | 7.02 | 7.87 | 8.00 | — | 7.01 | 6.27 | 6.23 | — |
| | Nitromethane | 0.22 | 0.27 | 0.27 | — | 0.22 | 0.20 | 0.20 | — |
| F | $C_2F_3Cl_3$ | 89.09 | 82.34 | 79.62 | — | 88.98 | 92.88 | 93.21 | — |
| | Methanol | 10.71 | 17.37 | 20.03 | — | 10.82 | 6.97 | 6.64 | |
| | Nitromethane | 0.20 | 0.29 | 0.35 | — | 0.20 | 0.15 | 0.15 | — |
| G | $C_2F_3Cl_3$ | 89.49 | 85.77 | 83.66 | 83.01 | 89.48 | 92.38 | 93.32 | 93.38 |
| | Methanol | 10.32 | 13.98 | 16.07 | 16.71 | 10.33 | 7.46 | 6.54 | 6.48 |
| | Nitromethane | 0.19 | 0.25 | 0.27 | 0.28 | 0.19 | 0.16 | 0.14 | 0.14 |
| H | $C_2F_3Cl_3$ | 86.78 | 80.14 | 76.31 | 74.83 | 86.79 | 91.67 | 92.95 | 92.96 |
| | Methanol | 13.03 | 19.58 | 23.36 | 24.83 | 13.02 | 8.19 | 6.93 | 6.92 |
| | Nitromethane | 0.19 | 0.28 | 0.33 | 0.34 | 0.19 | 0.14 | 0.12 | 0.12 |
| I | $C_2F_3Cl_3$ | 91.878 | 90.778 | 89.703 | 89.574 | 91.867 | 93.468 | 93.764 | 93.759 |
| | Methanol | 8.104 | 9.198 | 10.275 | 10.403 | 8.115 | 6.515 | 6.221 | 6.224 |
| | Nitromethane | 0.018 | 0.024 | 0.022 | 0.023 | 0.018 | 0.017 | 0.015 | 0.017 |

NOTES: (1)
A - After charging, prior to equipment operation
B - After 1 hr. of operation
C - After 4 hrs. of operation
D - After 8 hrs. of operation

EXAMPLES 1 and 2 and COMPARISONS

This Example illustrates the azeotrope-like behavior of the compositions of this invention in contrast to the compositions outside the invention.

The ternary compositions shown in Table 1 were made up and charged into small, two-sump laboratory degreasers having sumps 10.16 cm × 17.78 cm × 17.78 cm deep (approximately 3210 cc/sump). An initial 30 cc analysis sample was removed from each sump immediately after the composition was charged to the sumps. The degreaser was then placed in operation and allowed to reflux for eight hours with 30 cc samples being removed from each sump after 1, 4 and 8 hours reflux.

All samples were analyzed by calibrated vapor phase chromatography. The degreaser was covered with a sheet of flat plastic to minimize loss of vapors due to drafts and convection currents. Solvent losses ranged from 1.25 to 8.7% of the initial boil sump volumes. The heat input to the boil sumps was such that the rinse

EXAMPLES 3-8 and COMPARISONS

These Examples show the influence of nitromethane on the stability of the inventive compositions in the presence of various metals under anaerobic conditions.

Samples (5 ml.) of the compositions and metals shown in Table 2 were placed in 1.59 cm. I.D. × 6.35 cm. glass vials with screw-caps lined with polytetrafluoroethylene. The aluminum samples were 6.03 cm. × 0.635 cm. × 0.159 cm. The galvanized steel sheets were 6.03 cm. × 0.635 cm. × 0.079 cm. The aluminum alloy had a 120-grit surface while the galvanized sheet was used as is. The sealed vials were placed in a bath at the boiling point of the solvent and deaerated by venting after 5 minutes at the boiling point. The test vials remained in the bath for 24 or 48 hours. The vials were then cooled and examined. Results are shown in Table 2.

In the Table: the % decomposition is based on the amount of $Cl^-$ found in the test system and the theoretical amount of $Cl^-$ that could be formed if 100% of the $CF_2ClCFCl_2$ solvent decomposed; "Nil" is equivalent to or less than 0.007% decomposed; VP = in contact with vapor phase; LP = in contact with liquid phase.

TABLE 2

| Composition of Test Solvent (wt. %) $CF_2ClCFCl_2$/Methanol/ Nitromethane | Example Number/ Comparison Letter | Test Metal | Test Time (Hrs) | Decomposition (%) | Appearance Changes of: Liquid | Metal |
|---|---|---|---|---|---|---|
| 93.86/6.14/0 | Comparison J | Galvanized Steel | 24 | 0.97 | V. sli. white ppt. Two liquid phases are present. | VP: Dezinced-100% LP: Dezinced/Dulled-50%/50% |
| 93.85/6.14/0.01 | Comparison K | Galvanized Steel | 24 | 0.96 | Same as above. | Same as above. |
| 93.81/6.14/0.05 | Example 3 | Galvanized Steel | 24 | NIL | None | None |
| 93.76/6.14/0.1 | Example 4 | Galvanized Steel | 24 | 0.07 | None | None |
| 93.56/6.14/0.3 | Example 5 | Galvanized Steel | 24 | 0.07 | None | None |
| 93.86/6.14/0 | Comparison L | Al-1100-alloy | 48 | 0.37 | None | VP: Mod. White-gel deposit-100% LP: Sli. etched/sli. colorless-gel deposit-100%/50% |
| 93.85/6.14/0.01 | Comparison M | Al-1100-alloy | 48 | NIL | None | None |
| 93.81/6.14/0.05 | Example 6 | Al-1100-alloy | 48 | NIL | None | None |
| 93.76/6.14/0.1 | Example 7 | Al-1100-alloy | 48 | NIL | None | None |
| 93.56/6.14/0.3 | Example 8 | Al-1100-alloy | 48 | NiL | None | None |

EXAMPLES 9-12 AND COMPARISONS

These Examples demonstrate the cleaning ability of soldered, electronic circuit boards employing compositions of this invention.

The boards used had a uniform circuit pattern on one side of a 3.49 × 3.18 cm. epoxy-glass substrate. Ten holes, drilled through the boards, provided opportunities for component mounting. Four holes were connected with two tinned wires crimped on the pattern side to simulate mounted components. These boards were fluxed by placing the patterned side in a pool of commercial-grade highly activated flux and the flux was cured by placing the fluxed side down on a clean aluminum surface on a steam plate for two minutes. The boards were then soldered by placing the fluxed surface on the skimmed surface of 50:50 Pb:Sn solder at 460°–470°F. (238.8°–243.3°C.) for 5.0 ± 0.2 seconds. The chips were then cooled and defluxed within one hour after soldering.

Defluxing was accomplished by immersing the boards, held by diagonal corners in forceps, in the boiling solvent contained in a small, stainless steel degreaser for a 4-minute period. The board was then raised into the vapor zone, where it was flushed for 15 seconds with clean solvent (representing condensate from the boiling solvent) and then allowed to remain in the vapor for 15–30 seconds before withdrawal. The aqueous conductivity testing was done immediately, as specified below, after defluxing.

The aqueous conductivity measurement was carried out as follows. A volume of deionized water, equivalent to 100 ml. for each 5 square inches of board surface, was placed in a graduated cylinder which contained a polytetrafluoroethylene coated, magnetic stirrer. The aqueous conductivity of the deionized water was measured to 0.01 $\mu$ mho/cm. by a standard Beckman conductivity cell connected to a conductivity bridge. The defluxed board was immersed in the blanked water, the magnetic stirrer was activated, and the increase in aqueous conductivity was recorded at one-half minute intervals up to two minutes. The art-recognized limit recommended for acceptable cleaning of electroplated parts is a maximum increase of 1.0 $\mu$ mho/cm. aqueous conductivity.

At least three separate determinations were made on each test reported here, and the results were averaged and rounded off to the nearest 0.1 $\mu$ mho/cm. At less than the 1.0 $\mu$ mho/cm. level, the separate readings agreed to ± 0.04 $\mu$ mho/cm. and the higher readings agreed to ± 0.07 $\mu$ mho/cm.

The results, reported in Table 3, show that the compositions of this invention provide acceptable cleaning of printed circuit boards. It should be noted that if any nitromethane remains on the boards after defluxing, it could contribute to conductivity. The effect does not appear to be significant in the results.

TABLE 3

| Example No./ Comparison Letter | Defluxing Solvent, % by Weight $CF_2ClCFCl_2$ | $CH_3OH$ | $CH_3NO_2$ | All Flux Removed | Average Conductivity Increase $\mu$mho/cm. |
|---|---|---|---|---|---|
| 9 | 93.6 | 5.9 | 0.5 | Yes | 0.9 |
| 10 | 93.2 | 6.3 | 0.5 | Yes | 0.9 |
| 11 | 93.9 | 5.9 | 0.2 | Yes | 0.5 |
| 12 | 93.9 | 5.9 | 0.2 | Yes | 0.4 |
| Comparison N | 94.1 | 5.9 | 0 | Yes | 0.8 |
| Comparison O | 93.7 | 6.3 | 0 | Yes | 0.7 |
| Comparison P | 93.7 | 5.9 | 0 | Yes | 0.4 |

EXAMPLE 13

This Example demonstrates ten-day use simulation in a three sump degreaser.

The apparatus was a three sump vapor degreaser consisting of a boil sump, rinse sump and spray sump. To simulate use conditions during the ten-day test, two loops of brass window-sash chain (2.13 m. long each, 1.14 links/cm., 1.5875 mm. wire) were moved continuously, by means of a motordriven pulley and slave pulleys, through the following positions: (1) air space above the degreaser and in degreaser, (2) solvent vapor, (3) boiling solvent, (4) solvent vapor, (5) rinse sump solvent, (6) solvent vapor, and (7) air space in and above degreaser. During the first 24 hours, the chain was not running.

Vapors from the boil sump were condensed and returned to the spray sump. Overflow from the spray sump passed to the rinse sump and overflow from the rinse sump passed to the boil sump.

Dimensions and contents of the sumps were as follows: boil sump – 30.48 × 30.48 × 29.21 cm. – 50.42 kg., rinse sump – 25.4 × 30.48 × 36.83 cm. – 49.00 kg., spray sump – 17.78 × 30.48 × 22.56 cm. – 18.14 kg. The degreaser vapor area open to the atmosphere includes only the area above the boil and rinse sumps – 1700 cm.$^2$ (30.48 × 55.88 cm.). The freeboard ratio was 0.83 (25.4 ÷ 30.48 cm.). The heat input (1548.4 kcal./hr.) into the boil sump and estimated heat of vaporization of 48.99 cal./g. of the solvent gave rinse sump and spray sump turnover rates of 0.7 and 1.8 times/hr., respectively.

Samples of the liquids were taken for gaschromatographic analysis from the boil and rinse sumps immediately after charging the three sumps while the liquids were still at room temperature and after the time schedule shown in Table 4. Supplementary samples were also taken from the spray sump at a later time. The solvent-loss rate does not include the amount of solvent removed for analyses. Prior to the taking of the 31-ml. samples, the temperatures of the liquid in the boiling-solvent sump were measured and corrected to 760 mm. pressure. After the taking of the samples, the liquid level was set to the original maximum-fill position (100% fill) so that the loss rate could be calculated more precisely. During other times, the boil sump was automatically filled to "100%-fill" when the liquid level fell to the 90%-fill position. The fresh makeup solvent was transferred by gravity feed from a tared 18.93 l. drum reservoir into the bottom of the rinse sump. The solvent loss rates during the first 24 hours and the balance of the test were, respectively, about 0.5 and an average 2.2 Kg/[(hr)(sq.m)].

Results of the analyses of the liquid samples taken from the three sumps are summarized in Table 4. It is noted in connection with the temperature calculations that the thermistor used in this study was corrected additionally for temperature readout against a mercury thermometer which was calibrated in the condensing vapor of $C_2F_3Cl_3$ contained in an ebullioscope. All of the numbers were subtracted by 0.1°C. (actual correction was –0.08°C.). The thermistor temperature readout intervals were 0.6°C. Interpolations were made to about 0.2°C.

TABLE 4

| Solvent Makeup | | | | Example 13 Ternary Mixture Composition (Wt.-%) - wherein Methanol and Nitromethane Concentrations are shown, balance is $C_2F_3Cl_3$ | | | | | |
|---|---|---|---|---|---|---|---|---|---|
| | | | | Boil Sump | | Rinse Sump | | Spray Sump | |
| Time (Hrs.) | At Time Wt. Check (kg.) | Accumulative % of Original Charge | Boil Sump Temperature Corrected to 760 mm | Methanol | Nitromethane | Methanol | Nitromethane | Methanol | Nitromethane |
| — | — | — | — | 5.93[a] | 0.49[a] | 5.92[a] | 0.49[a] | (5.92) | (0.49) |
| 0 | 0[b] | 0 | 39.7 | — | — | — | — | — | — |
| 4 | — | — | 39.8 | 5.92 | 0.53 | 5.95 | 0.43 | — | — |
| 24 | 2.268 | 1.9 | 39.8 | — | — | — | — | — | — |
| 48 | 9.825 | 10.3 | 40.0 | 5.82 | 0.55 | 5.94 | 0.44 | — | — |
| 72 | 9.652 | 18.5 | 40.0 | — | — | — | — | — | — |
| 96 | 8.464 | 25.7 | 39.8 | 5.86 | 0.56 | 5.91 | 0.45 | — | — |
| 168 | 21.52 | 44.0 | 39.7 | 5.87 | 0.57 | 5.88 | 0.45 | — | — |
| 192 | — | — | — | 5.84 | 0.56 | 5.91 | 0.45 | 5.89 | 0.44 |
| 216 | 10.13 | 52.6 | 39.8 | 5.90 | 0.57 | 5.89 | 0.45 | 5.88 | 0.44 |
| 240 | 8.165 | 59.6 | 39.9 | 5.92 | 0.58 | 5.87 | 0.45 | 5.86 | 0.45 |

NOTES:
[a]Analyzed the room temperature solvents in the boil and rinse sump immediately after all three sumps were filled.
[b]About 10 minutes after the solvent began to boil and the vapor blanket was formed.

The embodiments of the invention in which an exclusive property or privilege is claimed are defined as follows:

1. An azeotrope-like composition consisting essentially of from 5.0 to 6.3 weight percent of methanol, from 0.05 to 0.6 weight percent of nitromethane and from 93.1 to 94.95 weight percent of 1,1,2-trichloro-1,2,2-trifluoroethane.

2. A composition according to claim 1 consisting essentially of from 5.5 to 5.9 weight percent of methanol, from 0.1 to 0.3 weight percent of nitromethane and from 93.8 to 94.4 weight percent of 1,1,2-trichloro-1,2,2-trifluoroethane.

* * * * *